US011608636B1

(12) United States Patent
Underkofler et al.

(10) Patent No.: US 11,608,636 B1
(45) Date of Patent: Mar. 21, 2023

(54) T-GRID TO BAFFLE BAR BRACKET

(71) Applicant: USG Interiors, LLC, Chicago, IL (US)

(72) Inventors: Abraham M. Underkofler, Salem, WI (US); Peder J. Gulbrandsen, Aurora, IL (US); Eric H. Kremer, Westlake, OH (US); Faris Alnakkar, Oakville (CA)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 17/455,263

(22) Filed: Nov. 17, 2021

(51) Int. Cl.
*E04B 9/22* (2006.01)
*E04B 9/36* (2006.01)
*E04B 9/06* (2006.01)

(52) U.S. Cl.
CPC ..... *E04B 9/225* (2013.01); *E04B 9/068* (2013.01); *E04B 9/366* (2013.01)

(58) Field of Classification Search
CPC ..... E04B 9/225; E04B 9/068; E04B 9/366
See application file for complete search history.

(56) References Cited

U.S. PATENT DOCUMENTS

| | | | | |
|---|---|---|---|---|
| 4,041,668 | A * | 8/1977 | Jahn | E04B 9/16 52/506.09 |
| 10,174,501 | B1 | 1/2019 | Underkofler et al. | |
| 10,472,817 | B2 * | 11/2019 | Harnish | E04B 9/06 |
| 10,508,444 | B2 * | 12/2019 | Gillette | E04B 9/0414 |
| 10,514,127 | B2 * | 12/2019 | Wu | E04B 9/006 |
| 11,486,141 | B2 * | 11/2022 | Baxter | E04B 9/245 |
| 2018/0127976 | A1 * | 5/2018 | Gillette | E04B 9/045 |
| 2019/0040622 | A1 * | 2/2019 | Harnish | E04B 9/06 |
| 2019/0203881 | A1 * | 7/2019 | Wu | E04B 9/068 |
| 2021/0301525 | A1 * | 9/2021 | Baxter | E04B 9/245 |
| 2022/0018127 | A1 * | 1/2022 | Magin | E04B 9/225 |

* cited by examiner

*Primary Examiner* — Rodney Mintz
(74) *Attorney, Agent, or Firm* — Pearne & Gordon LLP

(57) ABSTRACT

An elongate sheet metal body for attachment to the web of a grid tee, the body having a substantially right angle cross-section formed by legs that in use are vertical and horizontal, respectively, the vertical leg having a width adapted to fit against the web between a reinforcing bulb and lower flange of the tee, the horizontal leg having a width at least that of the width of a portion of the flange portion extending from the web to a free edge of the flange, the horizontal leg having at a free edge a plurality of depending lugs spaced uniformly from one another with a common center to center distance, the lugs having a horizontal width sized to fit into U-shaped baffles such that said baffles carried on said lugs have the same center to center distance as the lugs.

7 Claims, 3 Drawing Sheets

T-GRID TO BAFFLE BAR BRACKET

BACKGROUND OF THE INVENTION

The invention relates to suspension of metal channel-like baffles or like products typically at ceiling height.

PRIOR ART

Suspended ceilings commonly utilize a metal grid, suspended by wires depending from overhead structure. Openings in the grid are usually closed by panels or tiles assembled on the grid. Such a construction is useful, particularly in commercial buildings because it affords access to the plenum above the ceiling in which utilities including wiring, plumbing, air ducts are situated and need, from time to time, repair, alteration and/or addition.

In recent times, baffles have been used at ceiling height to improve acoustics and/or aesthetics. One form of such baffles is U-shaped metal channels arranged with their open side facing upwardly. It is known to fasten these channels to the underside of conventional ceiling grid with individual clips. This construction is labor intensive particularly where numerous baffles are used and it is desired to maintain a uniform center to center distance between the baffles.

SUMMARY OF THE INVENTION

The invention provides a structure compatible with conventional ceiling grid tees that is arranged to suspend baffles with a uniform center to center spacing. The invention is shown as an elongated sheet metal body mainly with a right angle cross section conforming to the dimensions of a grid tee. Lugs, depending from one of the legs of the right angle, each engage a respective baffle to both suspend the baffle and uniformly space it from adjacent baffles.

Ideally, the depending lugs have the shape of a spear tip to facilitate assembly of U-shaped sheet metal baffles by assisting to center a baffle with respect to the lug and, to some degree, in temporarily spreading the sides of a baffle to enable the baffle to snap into an interlocking relation with the lug. Tabs, preferably inconspicuously small, at the ends of the inventive angle body are proportioned to engage the flanges of cross tees to assure that the body is properly located.

DESCRIPTION OF THE PREFERRED EMBODIMENT

Figure 1:
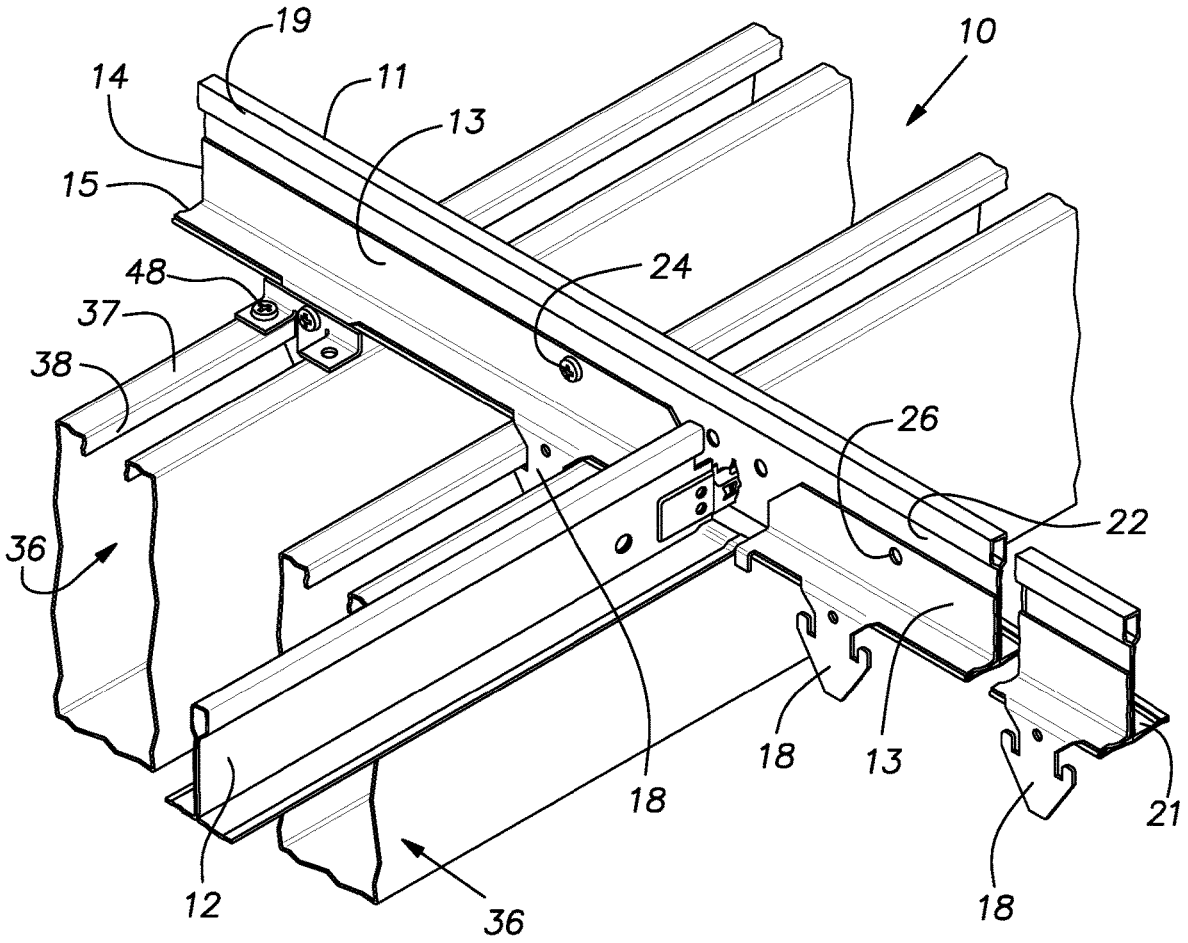
FIG. 1 is a fragmentary isometric view of the inventive hanger attached to a grid tee and suspending open top U-shaped baffles.
Figure 2:
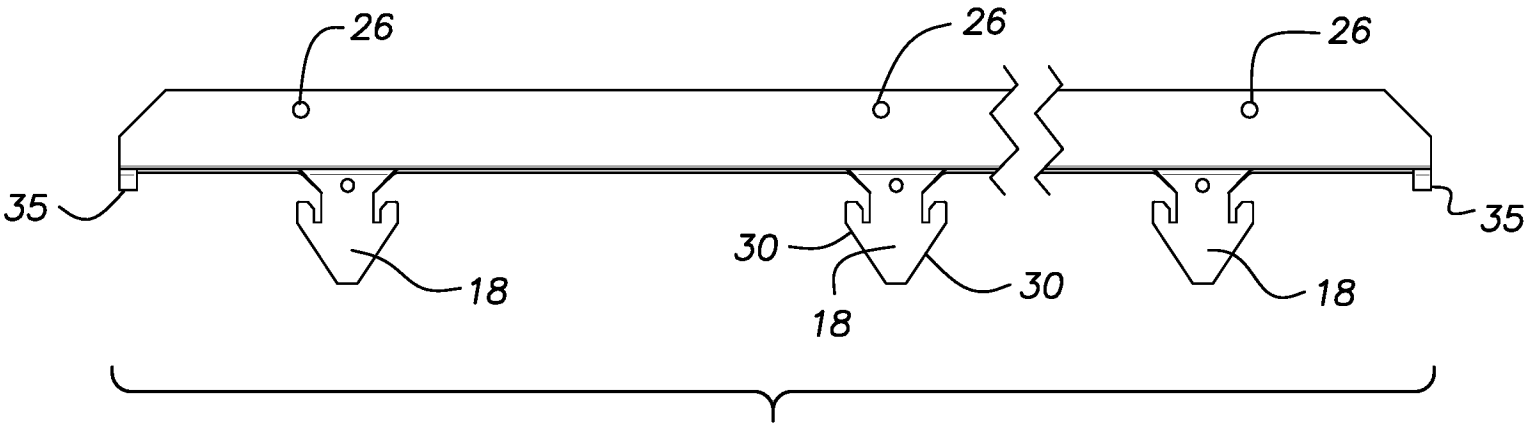
FIG. 2 is a side view of a baffle hanger.

In FIG. 1, a ceiling system 10 includes a rectangular grid represented by a main grid tee 11 and a cross tee 12 intersecting the main tee at right angles. FIG. 2 illustrates a hanger or bar 13 formed of sheet metal of, for example, 0.040 inch gauge aluminum. The hanger 13 is primarily a right angle body in cross-section with a vertical leg 14 and a horizontal leg 15. Lugs 18 integral with the body of the hanger 13 depend vertically from the horizontal leg 15.

The hanger legs 14 and 15 have respective widths determined by a conventional grid tee so that the vertical leg 14 fits between a reinforcing bulb 19 and a flange 21 of a tee and the horizontal leg 15 extends across one side of the flange 21 from a vertical web 22 to a distal edge of the flange. The nominal lengths of the hanger 13 are 2 feet and 4 feet but as shown in FIG. 1, the hangers are slightly less than these nominal dimensions so that they fit between adjacent grid tee flanges. At each end of the hanger 13 is a tab 35 that indexes to the edge of a grid tee flange 21.

The vertical leg 14 abuts the tee web 22 when the hanger 13 is installed by a technician on a grid tee 11 or 12 and is secured to the web by self-drilling screws 24 assembled through longitudinally spaced preformed holes 26 in the vertical leg. The horizontal leg is sufficiently wide to extend over the free edge of a respective flange 21.

The lugs 18 are uniformly spaced along the length of the hanger 13. For example, the center to center spacing between the lugs 18 can be 4, 6, 8, or 12 inches.

Figure 4:
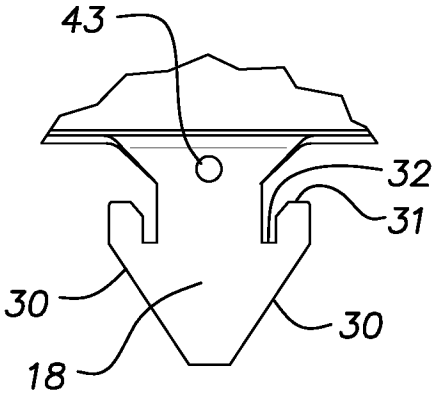
FIG. 4 is an enlarged side view of an individual depending lug of the hanger.
Figure 3:
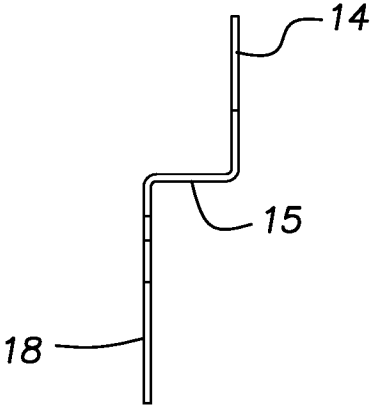
FIG. 3 is an end view of the baffle hanger of FIG. 2.

As best seen in FIG. 4, a lug 18 has the profile of a spear tip with divergent edges 30 that separate from one another with increasing proximity to the horizontal leg 15. Horizontal ledges 31 and vertical notches 32 are provided on each side of a lug 18 adjacent its upper region and vertically spaced from the horizontal leg 15. A hole 33 is provided at the horizontal center of a lug 18 adjacent its upper end.

Figure 5:
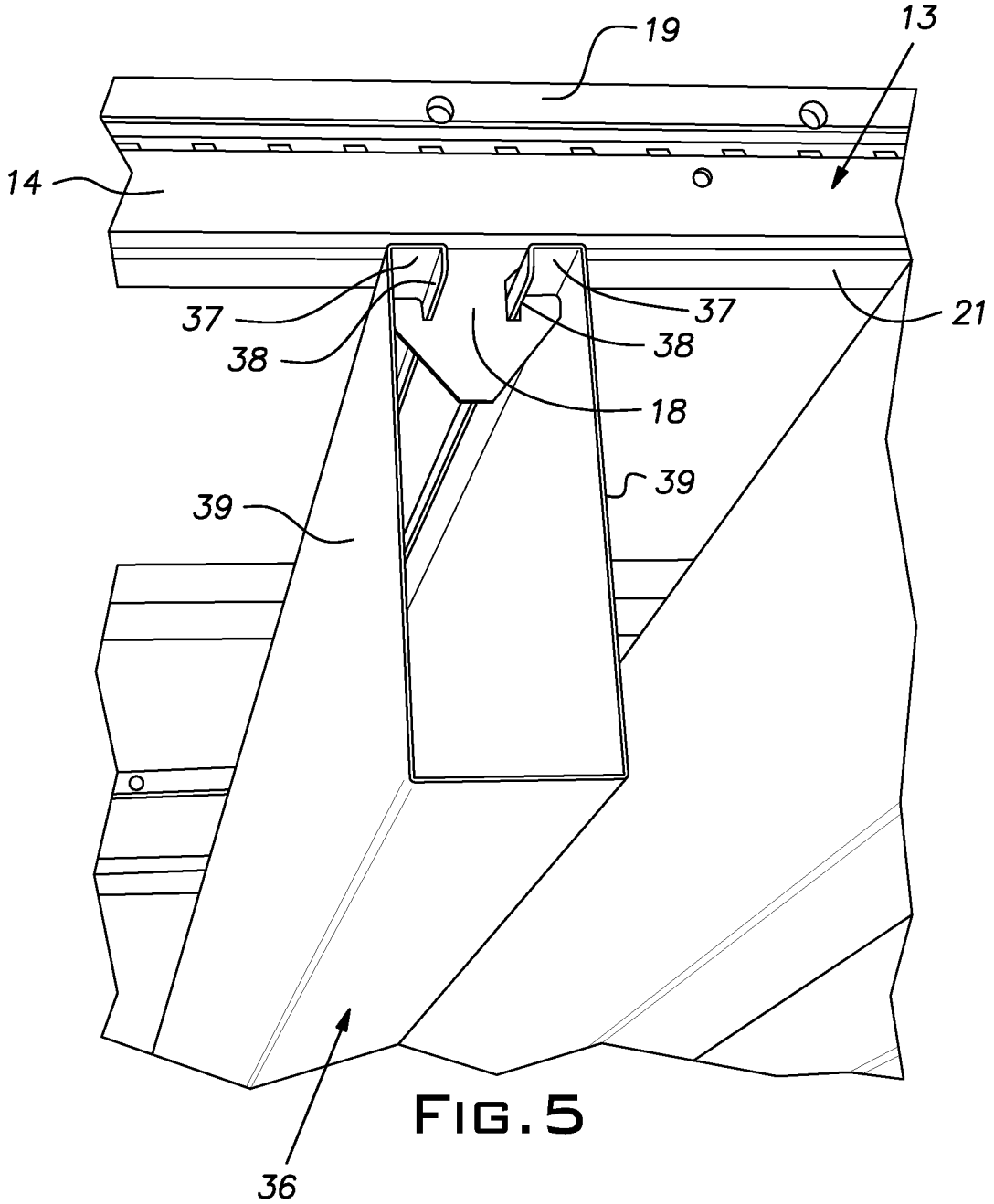
FIG. 5 is an isometric view of a baffle supported on a hanger lug.
Figure 7:
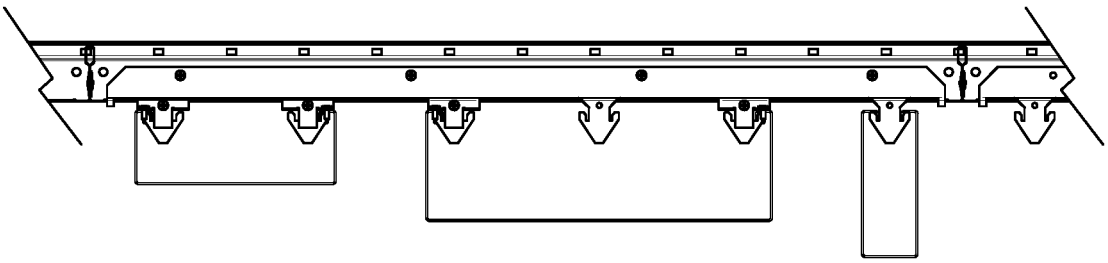
FIG. 7 exhibits the hanger supporting a variety of ceiling panels of various widths and heights.

FIG. 5 illustrates the cross-section of a sheet metal baffle 36 compatible with the profile of a lug 18. The baffle 36 has a U-shaped cross-section, open at a top, with opposed inturned horizontal flanges 37 that each include a vertically depending lip 38 at their free end. The depth of the baffle 36 is at least equal to the length of a lug 18 measured from its lowermost tip to its horizontal ledge 31. The baffles 36 can be formed from sheet metal such as, for example, 0.030 or 0.040 inch gauge aluminum.

Figure 6:
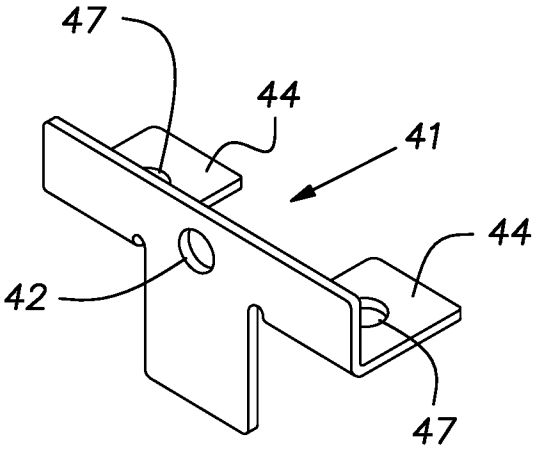
FIG. 6 is an isometric view of a clip useful in seismic conditions.

In a typical installation, the hangers 13 can be located on 4 foot or 8 foot centers with their respective lugs 18 in alignment. With the hangers 13 accordingly fixed on associated grid tees 11 or 12, a baffle can be installed on a set of aligned lugs 18 by raising it so that the lugs enter its open top. The divergent lug edges 30 tend to cam sides 39 of the baffle resiliently apart when contacting the baffle flange 37. The technician can assist this spreading action by gripping and spreading the baffle sides 37. The baffle 36 is raised until the baffle flanges 37 and lips 38 reach the horizontal ledges 31 of the lugs 18 and the baffle sides resiliently snap the flanges and lips into the vertical lug notches 32 and the baffle installed position of FIG. 5 is obtained at each involved lug.

Where seismic activity is a concern, a T-shaped sheet metal clip 41 shown in FIG. 6, can be used to positively secure a baffle 36 to a lug 18. The clip 41 has a central preformed hole 42, in a vertical stem portion that can be aligned with a preformed hole 43 in a lug 18 to receive a screw 44 as shown in FIG. 1. Horizontal tabs 44 of the clip 41 bent out of a main plane of the clip have preformed holes 47 to receive a screw 48 driven into a baffle flange 37 thereby positively coupling the baffle 36 to the hanger 13 and the grid tee 11 or 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In combination, a grid tee having a lower flange, an upper reinforcing bulb, and an intermediate web, and an elongate sheet metal hanger having a right angle cross-section formed by a vertical leg and a horizontal leg, the vertical leg being fixed to the web with the horizontal leg overlying the flange, the horizontal leg having regularly spaced vertically depending lugs disposed below the flange, the lugs having a spear head shaped profile with opposed notched edges below and adjacent the flange, and open top U-shaped sheet metal baffles each having substantially vertical sides with an inturned flange at a top of each side, the inturned flanges being secured to the lugs by inter-engagement with the notched edges.

2. The combination as set forth in claim 1, wherein the vertical leg having a width fit against the web between the reinforcing bulb and the lower flange of the tee, the horizontal leg having a width at least that of a width of a portion of the flange extending from the web to a free edge of the flange, the horizontal leg having at a free edge a plurality of the depending lugs spaced uniformly from one another with a common center to center distance, the lugs having a horizontal width fit into the U-shaped baffles such that said baffles carried on said lugs have the same center to center distance as the lugs.

3. The combination as set forth in claim 2, wherein an upper end of the lug receives the inturned flanges at upper open faces of the U-shaped baffles.

4. The combination as set forth in claim 3, wherein said grid tee is a first grid tee, and adjacent to longitudinal ends of the hanger, the horizontal leg has depending tabs that abut flanges of grid tees intersecting said first grid tee.

5. The combination as set forth in claim 2, wherein said lugs have opposed upwardly extending edges, the edges diverging from one another with distance from a lower end of the lug.

6. The combination as set forth in claim 5, wherein the edges of the lug form notches adjacent an upper end of the lug.

7. The combination as set forth in claim 6, wherein the notches vertically support the baffles.

* * * * *